United States Patent [19]

Hyun et al.

[11] Patent Number: 5,060,793

[45] Date of Patent: Oct. 29, 1991

[54] COUPON STORAGE DEVICE KIT

[75] Inventors: David K. Hyun; William H. Morgan, both of Pasadena, Calif.

[73] Assignee: Value Savers Unlimited, Pasadena, Calif.

[21] Appl. No.: 591,038

[22] Filed: Oct. 1, 1990

[51] Int. Cl.[5] ..... B42D 15/00; B42F 21/00; B65D 69/00

[52] U.S. Cl. ..... 206/232; 283/36; 283/56; 283/67

[58] Field of Search ..... 206/223, 232; 283/67, 283/36, 56

[56] References Cited

U.S. PATENT DOCUMENTS

| | | | |
|---|---|---|---|
| 3,804,323 | 4/1974 | Bemel | 206/232 |
| 4,260,055 | 4/1981 | Slaybaugh | 206/232 |
| 4,520,958 | 6/1985 | Jones et al. | 283/51 |
| 4,643,451 | 2/1987 | Coates | 283/56 |
| 4,685,699 | 8/1987 | Hirasawa | 283/56 |
| 4,795,196 | 1/1989 | Hyun et al. | 283/36 |

*Primary Examiner*—William I. Price

*Attorney, Agent, or Firm*—Christie, Parker & Hale

[57] ABSTRACT

A coupon storage device kit has a blank adapted to be folded into a storage bin, a plurality of divider sheets defining divider cards adapted to fit in the assembled bin to separate the space in the bin into individual compartments and a plurality of coupons adapted to be placed, by the consumer, into the individual compartments. The blank, divider sheets and coupons are wrapped and held together by plastic wrap. Each divider card has first and second visible fields. A generic product descriptor is printed in the first field of each divider card. A brand-name advertisement is printed in the second field of each divider card. The brand name product belongs to the class of the generic product, the descriptor which is printed on the same divider as, or a divider near, the advertisement of said brand-name product.

17 Claims, 4 Drawing Sheets

COUPON STORAGE DEVICE KIT

FIELD OF THE INVENTION

This invention relates to consumer products, and, more particularly, to a consumer kit for organizing and storing merchandising coupons.

BACKGROUND OF THE INVENTION

Brand-name manufacturers typically have large sums of money invested in advertising campaigns wherein they offer discount coupons to the consumer. The purpose behind these campaigns is obviously to get the consumer interested in the product by offering a discount off of the retail price. A consumer is more likely to buy a product if they feel they are saving money over the purchase of a competitors product. A large percentage of manufacturer's coupons, which are not distributed with the product to which they are directed, take the form of advertising supplements in newspapers or magazines.

Retail outlets often have campaigns designed to attract coupon collectors their particular establishment. One example of this is to offer the consumer double discounts for coupons redeemed at their establishment. The theory being that once in the store for the purchase of one product, the coupon collector will purchase other products at the same time. The key, of course, is to convince the consumer to shop at one establishment rather than another.

The coupon collector is faced with what can be a formidable challenge: that of cutting out the coupons, saving them and organizing them for use at the point of purchase. It is believed that a substantial number of potential coupon collectors do not collect coupons because of the inconvenience associated with the practice. Accordingly, the manufacturer's and the retailer's promotional efforts have no effect on these consumers since they do not engage in the practice of collecting coupons.

Still, the enormous amounts of money spent on coupon campaigns indicate that coupon collectors represent a fertile target audience for brand-name and retail outlet advertising methods. Further, it is submitted that this market can be further expanded by promoting the practice of coupon collecting itself.

SUMMARY OF THE INVENTION

This invention provides a consumer-product kit having component parts capable of being assembled by the consumer for providing a coupon storage device. The kit comprises a blank adapted to be folded into a storage bin, a plurality of divider sheets containing divider cards adapted to fit in the assembled bin to separate the space in the bin into individual compartments and a plurality of coupons adapted to be placed, by the consumer, into the individual compartments. The kit also contains a plastic wrap which integrates the other components in a kit form. Each divider card has first and second visible fields. A generic product descriptor is printed in the first field of each divider card. A brand-name product advertisement is printed in the second field of each divider card. The brand-name product belongs to the class of the generic product, the descriptor which is printed on the same divider as, or a divider near, the advertisement of said brand-name product. The disassembled kit is substantially flat and is to fit inside a shopping bag, such as a conventional plastic or paper shopping bag. The kit is intended to be a promotional item for retail stores or manufactures. The kit also encourages the practice of coupon collecting which enhances the manufacturers coupon campaign.

BRIEF DESCRIPTION OF THE DRAWINGS

The features of a specific embodiment of the best mode contemplated for carrying out the invention are illustrated in the drawings, in which.

DETAILED DESCRIPTION

Figure 1:
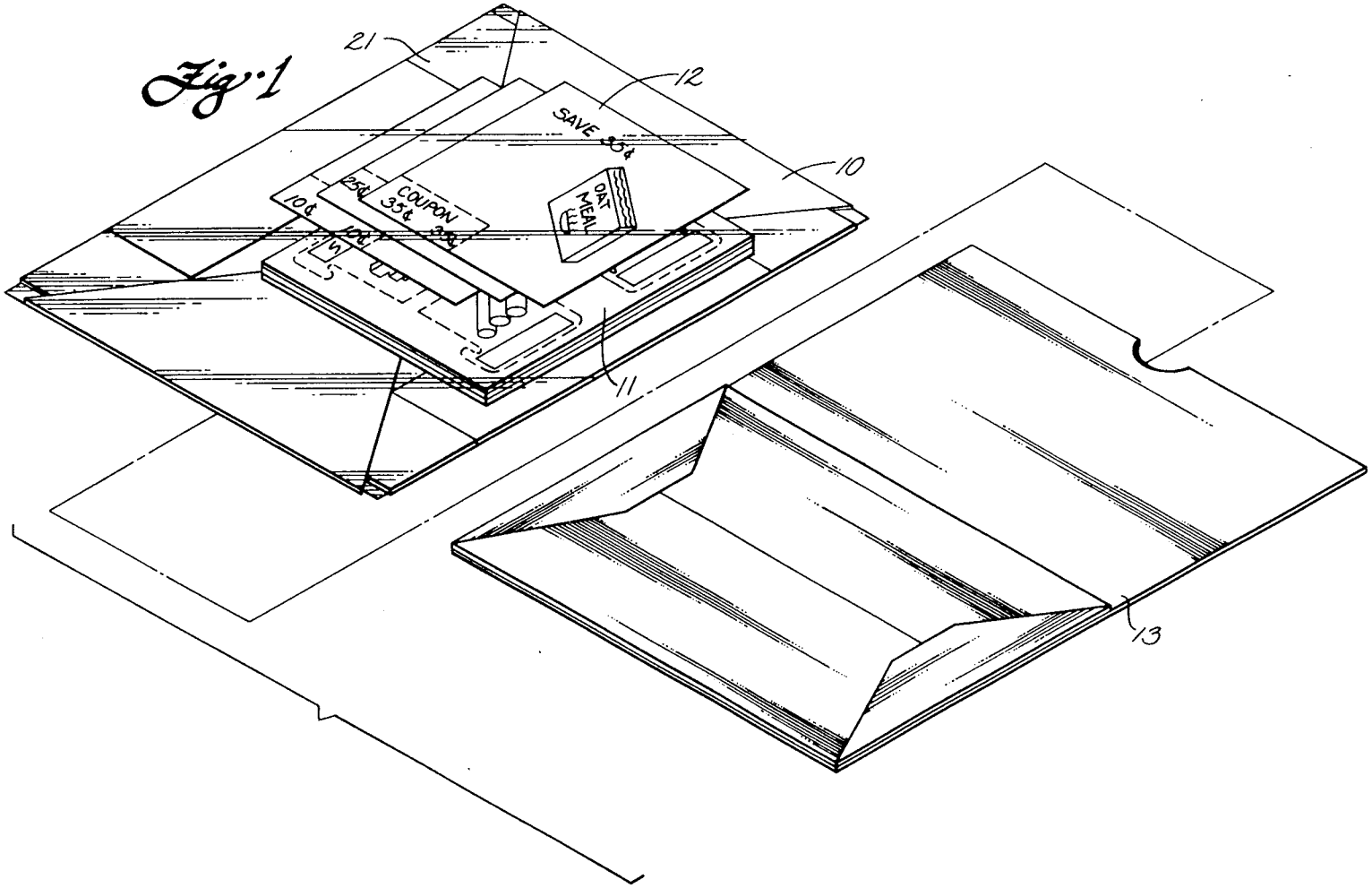
FIG. 1 is a perspective view of a coupon storage device kit showing one side of the kit in its unassembled configuration.

In FIG. 1 a consumer-product coupon storage device kit comprises a blank 10, a plurality of divider sheets 11 and a plurality of merchandising coupons 12 wrapped in plastic 21. The kit has exterior dimensions that permit it to be placed in a conventional brown paper shopping bag 13 for carrying by the consumer. The kit, when assembled, forms a coupon storage device similar to the device described in U.S. Pat. No. 4,795,196, by Hyun et al., the subject matter of which is hereby incorporated by reference.

Figure 2:
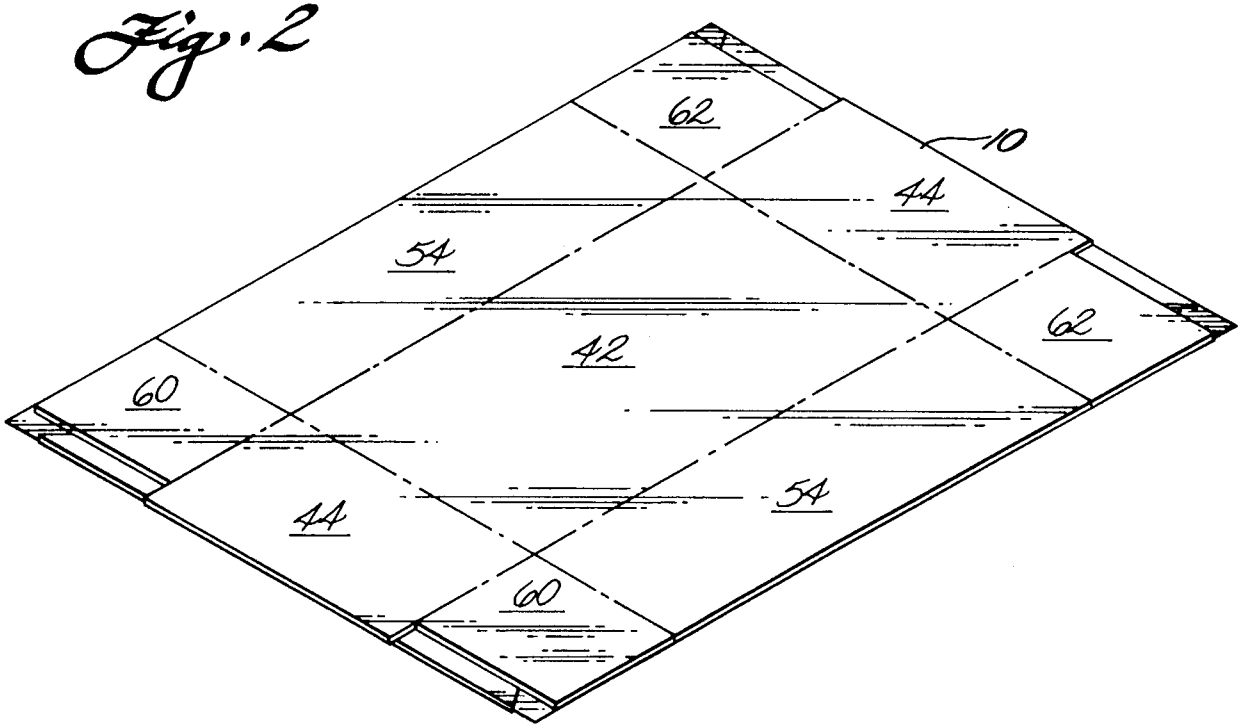
FIG. 2 is a perspective view of the kit shown in FIG. 1 showing the opposite side of the kit.
Figure 4:
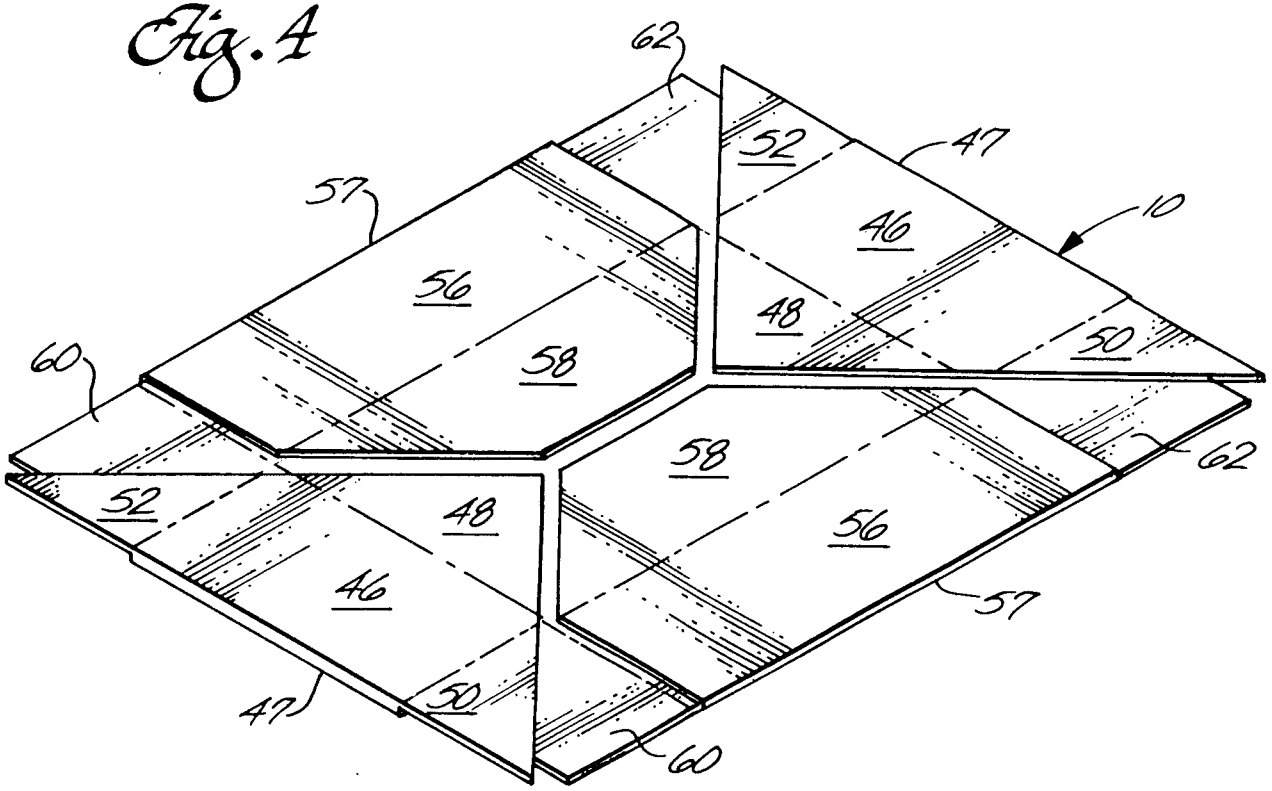
FIG. 4 is a perspective view of the storage bin of the kit of FIG. 1 in a disassembled and flat-folded state.

As best seen in FIGS. 2 and 4, the blank 10 is a single piece of cardboard having a number of perforated folds defining a number of sections in the blank. The blank, when assembled, forms a coupon storage bin having four sides, a bottom and an open top defining a cubical interior open space as disclosed in the '196 patent. To facilitate reference to the coupon storage bin disclosed in the '196 patent, the reference numerals used in FIGS. 2 and 4 are the same as the numerals used to refer to the various sections and folds of the storage bin in the '196 patent.

In the present invention, the blank 10 is folded in a substantially flat configuration having a bottom layer and a top layer. The portions of the blank making up the bottom layer are best seen in FIG. 2 (through the plastic wrap) and the portions of the blank making up the top layer can be viewed in FIG. 4. In other words, in its flat-folded configuration, a plurality of the sections of the blank lie in a first common plane (i.e. the section viewable in FIG. 2), and the remaining sections lie in a second common plane directly above the first common plane.

The first common plane (FIG. 2) includes the rectangular bottom section 42, the two rectangular end outside sections 44, the two rectangular side outside sections 54 and rectangular sections 60 and 62. The second common plane (FIG. 4) comprises the two rectangular end liner sections 46, the two rectangular side liner sections 56, the two triangular end floor sections 48, the two trapezoidal side floor sections 58 and the end triangular sections 50 and 52.

The flat-folded configuration is rectangularly shaped and is substantially flat since there are no more than two layers of cardboard at any one point along its perpendicular cross-section. The edges of the blank in its flat-folded configuration are defined by the folds 47 between the rectangular end outside sections 44 and the rectangular end liner sections 46 and the folds 57 between the rectangular side outside sections 54 and the rectangular side liner sections 56. The blank also has perforated folds between each of the other sections to ease the assembly of the storage bin by the consumer. These additional folds are indicated with dash-dot lines in FIGS. 2 and 4.

It can be seen that the bottom layer of the blank in its flat-folded configuration comprise those surfaces of the blank which will ultimately be on the outside of the assembled coupon storage bin (i.e. the bottom, end, and side surfaces). On the other hand, the top layer of the blank in its flat-folded configuration comprise those surfaces of the blank which will occupy the interior surfaces of the assembled coupon storage bin.

Although not shown in the drawings, each of the surfaces on the bottom layer of the flat folded configuration of the blank have a field associated with it for the display of advertising information. Thus, each of the outer surfaces of the assembled coupon storage bin have an advertisement field. These fields can contain advertisements for a retail business such as a market, convenience store, department or specialty store. Alternatively, these fields can contain advertisements for a brand-name product.

The steps required to assemble the storage bin from the blank are described in detail in the '196 patent.

Figure 3:
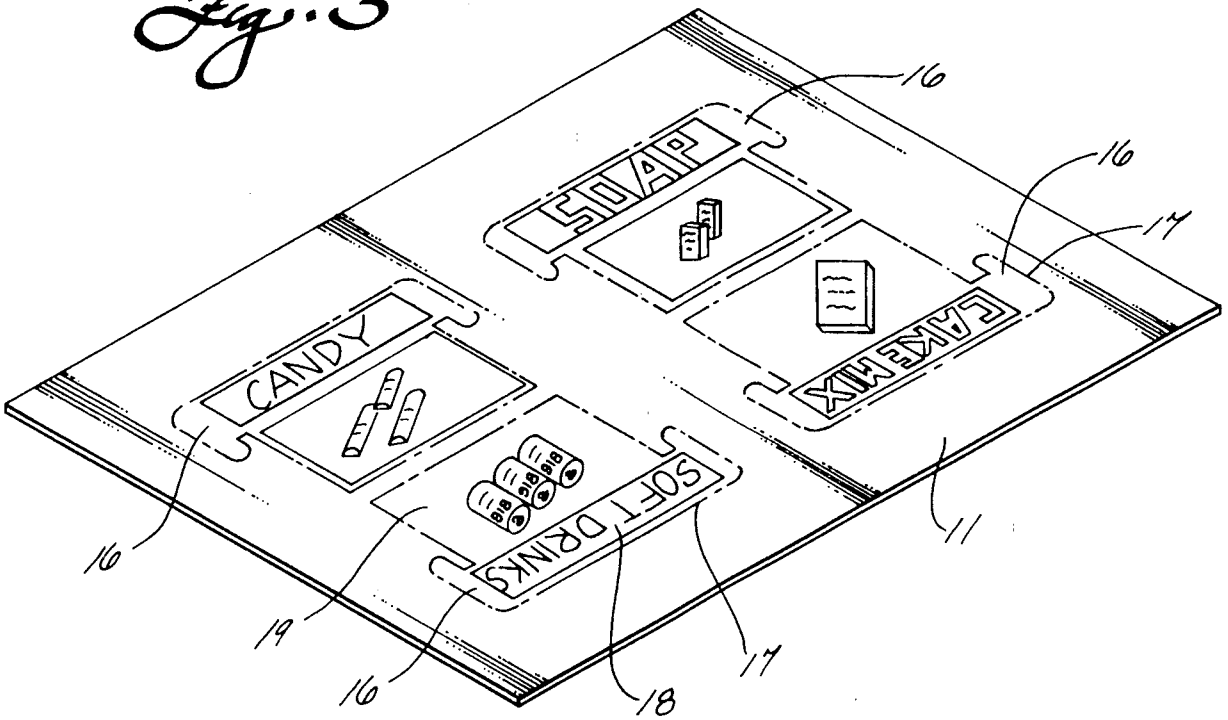
FIG. 3 is a perspective view of one of the divider sheets, containing a plurality of dividers, of the kit of FIG. 1.

Referring to FIG. 3, a divider sheet 11 is shown having four individual dividers cards 16 defined therein. The divider cards are of the same shape and design of the divider cards described in the '196 patent. The boundary of each divider card 16 is shown with a dashed line 17. This line 17 represents an area of weakness in the divider sheet, such as a perforation or a partial die-cut line, which allows the consumer to remove the divider cards 16 from the divider sheets 17 without having to use tools such as scissors or a knife. The divider cards are adapted to fit into the interior space of the assembled storage bin thereby separating the bin into individual compartments.

Each of the divider cards 16 has a first visible field 18 adjacent to the top edge of the divider card and a second field 19 that covers most of the rest of the surface of the divider card. A different generic product descriptor is printed in the first field 18 of each divider card. A brand-name product advertisement is printed in the second field 19 of each divider card. The brand-name product belongs to the class of the generic product descriptor printed on the divider card. For example, FIG. 3 shows divider cards having generic product descriptors of "Soft Drinks", "Cake Mix", "Candy" and "Soap". The advertisement printed on the divider card having a generic descriptor of "Soft Drinks")is for "Big" soft drinks, which is a fictional brand-name for soft drinks. The rear side of each of the divider cards (not shown in the drawings) has a field covering most of the rear surface in which a brand-name product advertisement is printed. The brand-name product can belong to the class of generic product, the descriptor of which is printed on the same divider card as the advertisement of said brand-name product, or to the class of the generic product, the descriptor of which is printed on the next adjacent, or a nearby, divider card.

Another element of the kit, as shown in FIG. 1, is a plurality of manufacturer coupons 12 and advertising material associated with the coupons. Thus, advertisements and discount coupons are distributed along with a product, the coupon storage bin, that will encourage the consumer to collect coupons. Advertising supplements typically inserted in newspapers are of a sufficiently small enough size to fit within the confines of the kit. The advertising material included in the kit can also contain other promotional items such as sweepstakes entries or giveaway game playing pieces.

The blank 10, folded in its flat configuration, the divider sheets 11 having the divider cards defined therein and the manufactures advertising coupons 12 are integrated into a single unit by the use of a plastic wrap 21. In one embodiment, the blank, divider sheets and coupons are assembled in a stack, in the orientation shown in FIG. 1, and a plastic film is wrapped around the parts of the kit. The plastic wrap may be a shrink wrap or any other type of plastic wrap. The plastic wrap has no use in the assembled kit, rather it is intended that the wrap will be discarded once the other elements of the kit are removed therefrom.

In an exemplary embodiment, the size and shape of the kit is such that it will fit into a standard sized paper or plastic grocery bag 13. The grocery bag generally has an open top and an interior cubical space defined by a rectangular bottom and four rectangular side surfaces. At least one of the side surfaces, and typically two where oppositely facing sides have the same dimensions, is slightly larger than the kit to allow the kit to be slid in and out of the bag. In an exemplary embodiment, the packaged kit has a length of approximately fourteen inches, a width of approximately eleven inches and a thickness (or height) of approximately ½ inch. The size of the packaged kit allow for it to be placed in a shopping bag, say adjacent to one of the bags interior faces, without substantially interfering with the use of the bag for other products.

The packaging of a coupon storage device in kit form of this invention has many advantages. The kit allows retail businesses to distribute the coupon storage device, and thus their advertising message, in a cost effective manner. The coupon storage device kits can be stored in a smaller area than assembled storage devices and the kits can easily be slipped into the bags of the customers further, the kits may serve a promotional items themselves. These advantages also benefit brand-name manufacturers since their advertising messages are carried to the consumer by the distribution of the kits. The advertising messages of sponsors, brand-name product manufacturers and retail businesses is effectively delivered not only to the segment of the public that already collects coupons, but to potential coupon collectors who are looking for a way to make the time burdens of coupon collecting practical.

The described embodiment of this invention is illustrative and the scope of this invention is not to be restricted to the described embodiments. Those skilled in the art to which this invention pertains will appreciate that alterations can be practices without departing from the principles and scope of this invention.

What is claimed is:

1. A kit for storing manufacturers coupons in an organized manner comprising:

a substantially flat blank, the blank being foldable into a storage bin; and a plurality of divider sheets, each having defined therein at least one divider card, the divider cards from the plurality of divider sheets being insertable into the storage bin thus separating the storage bin into individual compartments.

2. A kit for storing coupons as recited in claim 1 further comprising a plastic wrap embracing the blank and the plurality of divider sheets.

3. A kit for storing coupons as recited in claim 1 further comprising a plurality of manufacturer coupons insertable into the compartments formed by the storage bin and the divider cards.

4. A kit for storing coupons as recited in claim 3 further comprising a plastic wrap embracing the blank, the plurality of divider sheets and the plurality of manufacturer coupons.

5. A kit for storing coupons as recited in claim 2 wherein the divider cards further comprise a first field for printing a generic product descriptor and a second field for printing a brand-name advertisement.

6. A kit for storing coupons as recited in claim 5 wherein the brand-name advertisement on each card is directed to a product in the class of the generic product descriptor on the card.

7. A kit for storing coupons as recited in claim 2 having dimensions suitable to fit within a shopping bag.

8. A kit for storing coupons as recited in claim 1 wherein the kit has exterior dimensions that permit it to be placed in a conventional paper shopping bag.

9. A kit as for storing coupons as recited in claim 1 further comprising a grocery bag having an open top and a bottom surface and four side surfaces defining a cubical interior space, the grocery bag having at least one side dimensioned slightly larger than the blank to allow the blank to be inserted into and carried by the bag.

10. A consumer-product kit having component parts capable of being assembled by the consumer for providing a coupon storage device, the kit comprising the combination of:

a blank adapted to be folded into a storage bin having an open top with top edges and a cubical interior space;

a plurality of divider sheets, each sheet defining at least one removable divider card, the divider cards adapted to be fitted in the bin to separate the space in the bin into individual compartments, each divider card having a first visible field with a generic product descriptor printed therein and a second visible field with a brand-name product advertisement printed therein, each divider card also having top corners with notches into which the side edges of the bin fit; and a plurality of coupons adapted to be placed into the compartments by the consumer.

11. A consumer-product kit as recited in claim 10 wherein the blank is initially folded in a substantially flat configuration.

12. A consumer-product kit as recited in claim 11 wherein the blank, in its initially flat configuration, is sized to fit into a conventional shopping bag.

13. A consumer-device kit as recited in claim 10 further comprising a plastic wrap surrounding and holding together the component parts to provide an integrated kit of component parts.

14. A kit as recited in claim 10 wherein the divider cards in the divider sheets are defined by perforations in the divider sheet so that the divider cards can be removed from the divider sheets.

15. A kit as recited in claim 10 wherein each divider sheet defines four divider cards.

16. A method for assembling a coupon storage device kit, the kit having a blank component adapted to be assembled into a storage bin, a plurality of divider sheet components wherein each sheet has a plurality of removable divider cards defined therein and a plastic wrap embracing the blank and divider sheets and forming an integrated unit, the method comprising the steps:

tearing away the plastic wrap from the blank and divider sheets thus providing access to these components of the kit;

assembling the blank to form a storage bin;

removing each of the divider cards from their respective divider sheets; and inserting the divider cards into the storage bins to separate the storage bin into individual compartments.

17. A method as recited in claim 16 wherein the kit further comprises a plurality of manufacturer coupons and the method of assembling a coupon storage device kit further comprises depositing the coupons into the individual compartments formed in the storage bin by the divider cards.

* * * * *